US005679909A

United States Patent [19]

Kaneko et al.

[11] Patent Number: 5,679,909

[45] Date of Patent: Oct. 21, 1997

[54] SINTERED MATERIAL HAVING GOOD MACHINABILITY AND PROCESS FOR PRODUCING THE SAME

[75] Inventors: Tadataka Kaneko, Nagoya; Takehiko Esumi, Kyoto, both of Japan

[73] Assignees: Toyota Jidosha Kabushiki Kaisha; Japan Powder Metallurgy Co., Ltd., both of Japan

[21] Appl. No.: 620,189

[22] Filed: Mar. 22, 1996

[30] Foreign Application Priority Data

Mar. 24, 1995 [JP] Japan ..... 7-065649

[51] Int. Cl.[6] ..... C22C 33/00; B22F 3/12

[52] U.S. Cl. ..... 75/246; 75/235; 419/19; 419/38

[58] Field of Search ..... 75/246, 232, 235; 919/19, 38

[56] References Cited

U.S. PATENT DOCUMENTS

| | | | |
|---|---|---|---|
| 5,259,860 | 11/1993 | Ikenoue et al. | 75/231 |
| 5,326,526 | 7/1994 | Ikenoue et al. | 419/38 |
| 5,534,220 | 7/1996 | Purnell et al. | 419/45 |

FOREIGN PATENT DOCUMENTS

| | | |
|---|---|---|
| 4325531 | 2/1994 | Germany . |
| 63-93842 | 4/1988 | Japan . |
| 4-157139 | 5/1992 | Japan . |
| 7-11006 | 2/1995 | Japan . |
| 1 401 974 | 8/1975 | United Kingdom . |
| 2 248 850 | 4/1992 | United Kingdom . |

OTHER PUBLICATIONS

European Search Report dated Jul. 4, 1996 (2 pages).
Communication dated Jul. 12, 1996 (1 page).
Statement of Relevancy (1 page) (Discussing Japanese Patent Publication (KOKAI) No. 63-93842).
Statement of Relevancy (1 page) (Discussing Japanese Patent Publication No. 7-11006).

*Primary Examiner*—Ngoclan Mai
*Attorney, Agent, or Firm*—Finnegan, Henderson, Farabow, Garrett & Dunner, L.L.P.

[57] ABSTRACT

Disclosed are a sintered material having good machinability and process for producing the same. In the material, a composite oxide of CaO—MgO—$SiO_2$ family are dispersed in Fe-dominant metal matrix. Wherein the composite oxide has the molar ratio of CaO/MgO from 0.05 to 2.0 wt. %, and also has the content of $SiO_2$ from 50 to 75 wt. %. Hard particles of FeMo or such can be dispersed in the metal matrix. The maximum content of composite oxides in the sintered material are suggested to be 1.5 wt. % with the consideration of the mechanical strength. The sintered material can be cut with less tool wear and is produced by the process with low cost.

31 Claims, No Drawings

SINTERED MATERIAL HAVING GOOD MACHINABILITY AND PROCESS FOR PRODUCING THE SAME

BACKGROUND OF THE INVENTION

1. Field of the Invention

The present invention relates to sintered materials having good machinability and process for producing the same. The sintered materials can be used in valve seats and valve guides as the parts of internal combustion engines, and also in bearings, gears, pistons, cams and some other parts of industrial machineries.

2. Description of Related Arts

In recent industries, use of sintered materials is coming to be more popular because the materials can be formed in near-net-shape which is just close to finished works. Even though, most of the sintered materials are having high strength and high hardness, so that machinability of the materials is not good enough.

Therefore, research & development has been made to improve machinability of sintered materials. As a result, Fe-group sintered materials with additives of glass, talc and BN are disclosed. (See "Study on Machinability of Composite Sintered Material of Alloy Steel Ponder": Preprints for the meeting or Mie-district sub-branch, Tokai Branch, Japan Machinery Soc.: No.923-2, Jul. 17, 1992.)

Sintering materials are also disclosed which are made of iron-dominant matrix and dispersed magnesium meta-silicic-acid or magnesium ortho-silicic-acid (forsterite), which are thermo-stabilized and oleophilic. (Japan Unexamined Patent Publication (KOKAI) No. 4-157,139)

In process for producing sintered materials above-mentioned, however, it tends to form too much $SiO_2$ (cristobalite) or magnesium ortho-silicic-acid. Cristobalite would harm improvement of machinability and magnesium ortho-silicic-acid is having poor machinability. For the above reason, some trials are made to avoid forming cristobalite by use of magnesium meta-silicic-acid. Pure magnesium meta-silicic-acid does not exist in natural resources, so that it must be produced by refining process. The refining process causes excess cost on producing sintered materials.

SUMMARY OF THE INVENTION

This invention has been made under the consideration or above-mentioned situation in order to attain at least one of following objects.

It is the first object of present invention to provide sintered material having good machinability by defining. composition of composite oxide of CaO—MgO—$SiO_2$ family.

It is the second object of present invention to provide sintered material having good machinability and high strength by defining content of the composite oxide in addition to the definition of the first object.

It is the third object of present invention to provide process for producing sintered materials having good machinability. In the process, composite oxide is dispersed in metal matrix by the use or sintering process of metal matrix, where composite oxide with above-mentioned composition is synthesized from starting materials. By this way, complex oxide is produced without excess cost, so that production cost of the sintered material is suppressed.

The inventors of present invention have made studies on machinability of sintered materials. As a result of the studies, the inventors have found that generation of forsterite ($Mg_2SiO_4$) or Lime phase[(Ca,Mg)O] is avoided or suppressed in a process of producing a sintered material with metal matrix and composite oxide of CaO—MgO—$SiO_2$ family dispersed in the matrix. In the process, the molar ratio of CaO/MgO should be more than or equal to 0.05 and less than or equal to 2.0, and content of $SiO_2$ should be more than or equal to 50 wt. % (% by weight) and less than or equal to 75 wt. %. The inventors have made some experiments and have completed the present invention.

The first invention of the sintered material having good machinability is characterized by composite oxide is dispersed in metal matrix, where the composite oxide is one of CaO—MgO—$SiO_2$ family with molar ratio or CaO/MgO more than or equal to 0.05 and less than or equal to 2.0 and with content of $SiO_2$ more than or equal to 50 wt. % and less than or equal to 75 wt. %.

The second invention of the sintered materials having good machinability and high strength is characterized by composite oxide is dispersed in metal matrix by below 1.5 wt. %, where the composite oxide is one of CaO—MgO—$SiO_2$ family with molar ratio of CaO/MgO more than or equal to 0.05 and less than or equal to 2.0 and with content of $SiO_2$ more than or equal to 50 wt. % and less than or equal to 75 wt. %.

The third invention of process for producing the sintered materials having good machinability is characterized by following steps. In the first step, chemical compounds with Ca having tendency to isolate, chemical compounds of magnesium silicic acid family containing MgO and $SiO_2$, and metal powder which is to form metal matrix are mixed and turn to be mixture powder. In the second step, the mixture powder is compressed to form pressed body(herein the pressed body referred to as "green compact"). In the third step, the green compact is heated up to the temperature range fop sintering to synthesize composite oxide of CaO—MgO—$SiO_2$ family, and to form sintered material. Where, the sintered material consists of metal matrix and composite oxide of CaO—MgO—$SiO_2$ family is dispersed in the matrix. The composite oxide has CaO and MgO with molar ratio more than or equal to 0.05 and less than or equal to 2.0, and contains $SiO_2$ more than or equal to 50 wt. % and less than or equal to 75 wt. %.

The fourth invention of process for producing the sintered having good machinability is characterized by both of the chemical compound as starting materials being natural compounds in the third invention.

The following description would make it clear why the content must be defined.

(1) Reason why the range of molar ratio of CaO/MgO in the composition oxide is more than or equal to 0.05 and less than or equal to 2.0; In case if the composite oxide contains CaO/MgO less than 0.05 by molar ratio, forsterite($Mg_2SO_4$) and other oxides which would make machinability worse are tend to be synthesized. On the contrary, in other case if the composite oxide contains CaO/MgO more than 2.0 by molar ratio, Lime (such as (Ca,Mg)O) tends to be synthesized in the CaO—MgO—$SiO_2$ family as ternary phase diagram. Lime would induce poor machinability. By above reason, the range of molar ratio of CaO/MgO was defined as above-described. By the way, with consideration on machinability, cost and so on, the upper limit of the molar ratio is preferable to be 1.5, and is more desirable to be 0.5. Considering the same, the lower limit can be placed on 0.06.

(2) Reason why the range of content of $SiO_2$ in the composite oxide is to be core than or equal to 50 wt. % and less than or equal to 75 wt. %. In case if content of $SiO_2$ in the composite oxide is less than 50 wt. %, Periclose(MgO), for example, in the ternary phase compound would formed too much. On the contrary, in other case if the content of $SiO_2$ is more than 75 wt. %, $SiO_2$(cristobalite) is so much that it would harm machinability or the sintered material. In addition, considering over performance index such as machinability and cost, the upper limit of content of $SiO_2$ may be set to be 70 wt. % or 65 wt. %. And the lower limit may be set to be 55 wt. %, considering the same.

Among the composite oxides of CaO—MgO—$SiO_2$ family, there is $CaMgSiO_6$(Diopside on the ternary phase compound). There also are $(Ca,Mg)_2SiO_4$ in which some part of Mg has been replaced by Ca in forstelite structure, or $(Ca,Mg)SiO_3$ in which some part of Mg has been replaced by Ca in protoenstatite structure, and symbiotic compounds in which above-mentioned compounds.

In the present invention, the mean diameter of the composite oxide can be in the range of from 3 to 200 micrometers depending on the kind of the sintered material. The metal matrix can include the hard particles, whose mean diameter can be in the range of from 50 to 150 micrometers. As for the hard particles, FeMo particles, FeCr particles, Few particles, Tribaloy (Du Pont) composed of mainly Co—Ho—Cr family and Co—Ho—Si family, and the like can be employed.

With increase of content of composite oxides which meet the limitation mentioned above in sintered material, improvement effect on machinability comes to be significant. However, too much the composite components in sintered material put limitation on strength improvement. For above reason, in the second invention, content of the composite oxide is limited less than or equal to 1.5 wt. % compared to the weight of whole sintered material as 100 wt. %. Where, the upper limit and the lower limit are to be set case by case according to variety of sintered materials and requirements such as machinability, strength, cost and so forth. For example, the upper limit is set to be 1.3 wt. %, 1.0 wt. %, 0.8 wt. % or 0.5 wt. %, and the lower limit is set to be 0.1 wt. %, 0.2 wt. %, 0.3 wt. % or 0.5 wt. %.

The present invention includes sintered materials with above-mentioned composite oxide in which some of elements are replaced with Al, Fe, Ti and so forth. Further more, it is also possible to disperse some other elements too in metal matrix, where the elements are known as machinability improvement elements such as BN, MnS and so forth.

To obtain sintered materials with metal matrix and dispersed above-mentioned composite oxides, process for producing the same with following steps can be applied. Starting with composite oxides which clears the limitation of (1) and (2). The composite oxide should be prepared by synthesis or by refinement. In the first step, the composite oxides are added to metal powder to obtain mixed powder. In the second step, the mixed powder are compressed to form green compact. In the third step, the green compact is heated up and kept in temperature range for sintering. So metal matrix are combined by sintering and sintered materials are produced.

Generally speaking, however, it is not easy to earn natural minerals containing the composite oxide with high purity. And synthetic of the composite oxide costs too much in general.

By above-mentioned reason, the process of the third invention is beneficial. The process starts with compound in which Ca is isolated easily and with other compound of magnesium silicic acid containing MgO and $SiO_2$ as starting materials. In the first step of the process, both of the compounds and metal powder for forming metal matrix are mixed up to obtain mixed powder. In the second step, the mixed powder are compressed to form green compact. In the third step, the green compact is heated up and kept in the temperature range for sintering. While sintering, composite oxides of CaO—MgO—$SiO_2$ family are synthesized and the green compact changes into sintered material. In above-mentioned process, the composite oxides are synthesized with reasonable cost by making use of metal matrix sintering.

The temperature range for sintering is to be changed in accordance with contents of the green compact. In many cases, the range is set to be 1,000 to 1,300 degrees C.

Any of $CaCO_3$, $Ca(OH)_2$, $CaSO_4$ and so forth can be used as the compound in which Ca is isolated easily. According to a reference on this subject, above-mentioned compounds are supposed to be decomposed in following ways.

$CaCO_3$ is decomposed into CaO and $CO_2$ at 898 degrees C.

$Ca(OH)_2$ is decomposed into CaO and $H_2O$ at 580 degrees C.

$CaSO_4$ is decomposed into CaO and $SO_3$ at 1,200 degrees C.

Natural compound containing CaMg can be used as the compound containing Ca.

$CaMg(CO_3)_2$ can be used as a natural compound(natural mineral) having high purity which does not cost too much comparatively and is easy to obtain. Dolomite or mineral containing dolomite is one example of the natural compound containing $CaMg(CO_3)_2$. $Mg_XSi_YO_{X+2Y}$ can be used as the natural compound of magnesium silicic acid. Enstatite, forstelite and so forth are examples of $Mg_XSi_YO_{X+2Y}$.

Among natural minerals, there are some minerals which contain $CaMg(CO_3)_2$ and $Mg_XSi_YO_{X+2Y}$ at desired ratios. By adding the mineral or the mixture which contains $CaMg(CO_3)_2$ and $Mg_XSi_YO_{X+2Y}$ to metal powder which will form metal matrix, mixed powder is obtained. Compressing the mixed powder to form green compact, and sintering the green compact, some kind of composite oxides are synthesized by reaction in sintered material as the result. Where, the composite oxides are mainly made of $CaMgSi_2O_6$ (Diopside) and the rest are made of $(Ca,Mg)_2SiO_4$ and $(Ca,Mg)SiO_3$ and so forth. Diopside ensures the sintered material to have improved machinability.

The sintered material based on present invention contains composite oxide of CaO—MgO—$SiO_2$ family which clears the content limitation defined as (1) and (2) dispersed in metal matrix. Composite oxide which match the limitation has greater effect to improve machinability compared with well-known magnesium silicic acid which contains little Ca.

The reason of the effect is supposed that separability and cleavability are improved by warping in crystal structure of the material distorted by contained Ca, or that lubricant are formed on the surface or the protective layer of the tool by Ca contained in the material.

By the process based on the third invention, composite oxides are synthesized from starting materials while mixed and formed powder or pressed powder form are sintered to form metal matrix. Hence, the composite oxides of CaO—MgO—$SiO_2$family which matches to the limitation (1) and (2) are synthesized at moderate cost. Furthermore, the composite oxides are dispersed in the metal matrix effectively.

By the process based on the fourth invention, the composite oxides are synthesized in further moderate cost, because cheep natural compounds are used an starting materials.

In the sintered materials based on the first invention or the second invention, composite oxides which satisfy the contents limitation (1) and (2) improve machinability of the materials such more than well-known magnesium silicic acid does. Consequently, it is expected that the sintered materials can be cut in shorter time and that cutting tools can have longer lifetime.

Moreover, In the sintered materials based on the second invention, content of composite oxides which satisfy the contents limitation is described as to be less than or equal to 1.5 wt. %, so that the sintered materials are expected to have improved machinability without losing necessary mechanical strength.

In the producing process based on the third invention, composite oxides are synthesized from starting material powder in the step or sintering, so that the composite oxides are derived inexpensively. Hence, sintered materials having good machinability can be produced by the process without excess cost. In addition, composite oxides are well dispersed in metal matrix of the sintered material produced by the process, that is advantageous to improve machinability of the sintered material.

Further more, in the producing process based the fourth invention, composite oxides are synthesized form starting materials powder which are of natural compounds, so that the composite oxides are synthesized with lower cost.

DETAILED DESCRIPTION OF THE PREFERRED EMBODIMENTS

Having generally described the present invention, a further understanding can be obtained by reference to the specific preferred embodiments which are provided herein for purpose or illustration only and are not intended to limit the scope of the appended claims.

First Through Third Preferred Embodiments and Comparative Examples Nos. 1 through 5

Followings are description on the first through the third preferred embodiments and comparative examples Nos. 1 through 5.

To begin with starting materials, atomized pure iron(Fe) powder with grain diameter of 100 micrometers, Co powder with grain diameter below 75 micrometers, composite oxides powder or grain diameter below 60 micrometers, FeMo metal compound powder of grain diameter below 150 micrometers and natural graphite(Gr) powder of grain size below 25 micrometers are prepared. The Fe powder is to form Fe-dominant metal matrix. The Co powder is to ensure strength of resulted suitered material at high temperature. The FeMo powder is to form hard particles in the sintered material so that the hard particles would improve wear-resistance of the sintered material. Hardness of FeMo is usually about Hv1200. Natural graphite is to strengthen the metal matrix and to product carbides.

Molar ratio of CaO/MgO and content of $SiO_2$ are listed on Table 1. As shown in the table, molar ratio of composite oxides was 0.15, and content of the same was 62 wt. % in Ex. 1(First Preferred Embodiment). Molar ratio of composite oxides was 0.07, and content of the same was 60 wt. % in Ex. 2. The molar ratio was 2.00, and the content was 55 wt. %. On the other hand, the molar ratio was 3.65 end the content was 8 wt. % in Comp. Ex. 1(Comparative Example No. 1). The molar ratio was 1.30 and the content was 35 wt. % in Comp. Ex. 2. The molar ratio was 0.02 and the content was 56 wt. % in Conp. Ex. 3. The molar ratio was 0.08 and the content was 78 wt. % in Comp. Ex. 4. The molar ratio was 1.00 and the content was 52 wt. % in Comp. Ex. 5.

TABLE 1

| | Contents (W %) | | | | Molar ratio of | Content of $SiO_2$ | Composite oxides |
|---|---|---|---|---|---|---|---|
| Test piece | Fe | Co | Gr | FeMo | CaO/MgO | (wt. %) | (wt. %) |
| Ex. 1 | * | 5.0 | 1.0 | 5.0 | 0.15 | 62 | 0.3 |
| Ex. 2 | * | 5.0 | 1.0 | 5.0 | 0.07 | 60 | 0.3 |
| Ex. 3 | * | 5.0 | 1.0 | 5.0 | 2.00 | 55 | 0.3 |
| Comp. Ex. 1 | * | 5.0 | 1.0 | 5.0 | 3.65 | 8 | 0.3 |
| Comp. Ex. 2 | * | 5.0 | 1.0 | 5.0 | 1.30 | 35 | 0.3 |
| Comp. Ex. 3 | * | 5.0 | 1.0 | 5.0 | 0.02 | 56 | 0.3 |
| Comp. Ex. 4 | * | 5.0 | 1.0 | 5.0 | 0.08 | 78 | 0.3 |
| Comp. Ex. 5 | * | 5.0 | 1.0 | 5.0 | 1.00 | 52 | 0.3 |

*stands for "The rest".

Then, every kind of the powders were compounded to make each starting mixed powder for every case, i.e. Ex. 1–3 and Comp. Ex. 1–5 in the combination shown in Table 1. In Table 1, total weight of Fe, Co, Gr, FeMo and composite oxide are referred as 100 wt. %.

The compound oxide which has molar ratio of CaO/MgO and content of $SiO_2$ as shown in Table 1 was added to in the starting powder by 0.3 wt. % in every case. The composite oxide powder for Comp. Ex. 3 was talc[$Mg_3(Si_4O_{10})(OH)_2$] powder on the market. The composite oxide powder for Comp. Ex. 5 was powder reagent of magnesium meta-silicic-acid on the market.

Thus, powder of zinc stearic acid was also added to the starting powder by 0.8 wt. % compared to the starting powder as 100 wt. %. Each of the powder were mixed up individually in mixer machine to produce mixed powder of the each. The mixed powder were individually pressed under the pressure of 650 MPa to form the green compacts. Set of the green compacts were heated up and holded in reductive atmosphere i.e. $H_2$ gas at 1498K by 1,800 seconds. While the set of the green compacts were heated and kept in high temperature as mentioned above, the same were sintered and sintered materials were brought out as test pieces.

The test pieces were cut by tool into following specifications. The tool was checked after cutting each of the test pieces for 200 times, which means that flank wear of the tool was measered. The result of measurement is shown in Table 2. In Table2, flank wear is scaled relatively as 100 for Comp. Ex. 5 so that the difference between each test peace should be clear.

| [specifications] | | |
|---|---|---|
| Dimension of test piece | outer diameter | 30 mm, |
| | inner diameter | 16 mm, |
| | thickness | 7 mm |
| Tester machine | a lathe | |
| Tip of the tool | cBN | |
| Cutting fluid | none | |
| Cutting condition | cutting speed 95 m/min, feeding 0.048 mm/rev, 0.2 mm | |

TABLE 2

| Test piece | flank wear of tool (relative scaling) |
|---|---|
| Ex. 1 | 65 |
| Ex. 2 | 81 |
| Ex. 3 | 74 |
| Comp. Ex. 1 | 120 |

TABLE 2-continued

| Test piece | flank wear of tool (relative scaling) |
|---|---|
| Comp. Ex. 2 | 110 |
| Comp. Ex. 3 | 105 |
| Comp. Ex. 4 | 150 |
| Comp. Ex. 5 | 100 |

As shown in Table 2, wear of tool are listed-in relative scale as 100 for Comp. Ex. 5. Table 2 reads 65 for Ex. 1, 81 for Ex. 2, 74 for Ex. 3, while it reads 120 for Comp. Ex. 1, 110 for Comp. Ex. 2, 105 for Comp. Ex. 3, 150 for Comp. Ex. 4, respectively. Comparing the wearing or Ex. 1–3 with the same of Comp. Ex. 1–5, it is clear that adding composite oxide to starting material powder as the present invention mentions makes large reduction of tool wearing in case or cutting.

Undesirable composite are synthesized in every Comp. Exs., i.e., Lime phase was found in Comp. Ex. 1 where the molar ratio is 3.65, Periclose phase was found in Comp. Ex. 2 where exists little $SiO_2$, magnesium ortho-silicic-acid was found in Comp. Ex. 3 where the molar ratio is 0.02, $SiO_2$(cristobalite) was found in Comp. Ex. 4 where the molar ratio is 0.08. It is supposed that the undesired composite ruins machinability of sintering materials and increases wearing of tools.

Fourth through Sixth Preferred Embodiments and Comparative Examples Nos. 6 and 7

For Ex. 4–6, composite oxides were added to the starting material powder, where the composite oxides are shown as Ex. 2 in Table 1 (the molar ratio of $CaO/SiO_2$ is 0.07, the content or $SiO_2$ is 60 W %). As shown in Table 3, the composite oxide were contained in mixed powder by the ratio of 0.2 wt. % for Ex. 4, 0.7 wt. % for Ex. 5, 1.5 wt. % for Ex. 6, 0.0 wt. % for Comp. Ex. 6, 2.0 wt. % for Comp. Ex. 7. In all Exs. and Comp. Exs., sintered materials as test pieces were produced by the same process as above-mentioned Ex. 1–3. The contents of the test pieces are listed in Table 3.

TABLE 3

| | Contents (wt. %) | | | | Molar ratio of | Content of $SiO_2$ | Composite oxides |
|---|---|---|---|---|---|---|---|
| Test piece | Fe | Co | Gr | FeMo | CaO/MgO | (wt. %) | (wt. %) |
| Ex. 4 | * | 5.0 | 1.0 | 5.0 | 0.07 | 60 | 0.2 |
| Ex. 5 | * | 5.0 | 1.0 | 5.0 | 0.07 | 60 | 0.7 |
| Ex. 6 | * | 5.0 | 1.0 | 5.0 | 0.07 | 60 | 1.5 |
| Comp. Ex. 6 | * | 5.0 | 1.0 | 5.0 | 0.07 | 60 | 0.0 |
| Comp. Ex. 7 | * | 5.0 | 1.0 | 5.0 | 0.07 | 60 | 2.0 |

*stands for "The rest".
Gr: Graphite

Then, tool wearing tests were held for the test pieces in the same way as mentioned above. Further more, radial crushing strength tests based on JIS-Z2507 were also held for all test pieces. In the radial crushing strength tests, the test pieces were formed in the same dimensions as Ex. 1, and they were loaded radially with increasing load till they collapse. The result of the tests are shown in Table 4. In Table 4, measured radial crushing strength and wear of the tools are listed in relative scale so that difference between each test piece should be clear. In the same scaling, Comp. Ex. 6(no composite oxide added) were referred as 100.

As shown in Table 4, the measured radial crushing strength reads 100 for Ex. 4, 90 for Ex. 5, 78 for Ex. 6, 69 for Comp. Ex. 7, while the measured wear of tools reads 87 for Ex. 4, 65 for Ex. 5, 53 for Ex. 6, 51 for Comp. Ex. 7 in relative scaling mentioned above.

TABLE 4

| Test piece | Radial crushing strength | Frank wear of tools |
|---|---|---|
| Ex. 4 | 100 | 87 |
| Ex. 5 | 90 | 65 |
| Ex. 6 | 78 | 53 |
| Comp. Ex. 6 | 100 | 100 |
| Comp. Ex. 7 | 69 | 51 |

Table 4 shows that, as content of the composite oxides as additives to starting powder increases, wear of tools tend to decreases. Comparing the result of Ex. 6 (content of the composite oxides is 1.5 wt. %) with the result of Comp. Ex. 7 (the same is 2.0 wt. %, the radial crushing strength of the test pieces are decreased by large even though wear of tools decreases by a little in the range over 1.5 wt. % of composite oxides as additive contents. Hence, considering over the radial crushing strength, it is clear that upper limit of content of the composite oxides should he placed at 1.5 wt. % moderately.

In addition, the sintering material based on the second invention, the content of the composite oxides additives are limited to be 1.5 wt. % or below. However, if requirement on the strength of the sintering materials is moderate, and if requirement on the machinability (little wear of tools, for example) is hard, a better choice can be made by increasing additives, i.e., content of composite oxides over 1.5 wt. %. The choice would lead to produce sintering material which decrease wear of tolls. In this case, according to every kind of requirement, the upper limit of additive contents composite oxides in starting powder might be set to 3 wt. %, 5 wt. % 10 wt. %.

Seventh Preferred Embodiment

The starting powder of this embodiment consists of the pure iron powder on the market which has the same used in Ex. 1–3 by 93 wt. %, FeMo powder by 5 wt. %, natural graphite powder by 1 wt. %, zinc stearic acid by 1 wt. % as lubricant. All kind of the starting powder were mixed to form mixed powder. Then, other additives are added to the mixed powder, and the mixed powder were mixed up with the additives. Where, the additives are natural compounds (natural mineral such as dolomite containing $CaMg(CO_3)_2$ and natural oxides of magnesium silicic acid family. Resulted mixed powder contains the natural compounds by 10 wt. %, and also contained the natural oxides by 10 wt. %. The powder were compressed to form green compacts just in the same way as Ex. 1–3. Then the green compacts were heated up to the temperature range of sintering process, and kept in the temperature range as 1,100 through 1,200 degrees C. By above mentioned process, a test piece of sintering material were obtained.

The test piece was examined with a X-ray difractometer, and it is estimated what kind of compounds are contained in the test piece. As the result, it was made sure that $CaMgSi_2O_6$(Deopside phase) had been synthesized in the test piece or the sintered material. Deopside is known to be a composite which improves machinability of the material. In addition, there are some possibility that $(Ca,Mg)_2SiO_4$, $(Ca,Mg)SiO_3$, etc. are also synthesized.

For the next, dolomite was prepared as the natural compound (natural mineral) containing $CaMg(CO_3)_2$. The dolomite were mixed with other oxides containing $Mg_2Si_3O_8$ to form mixture, so that molar ratio of CaO/MgO came to be 1.8, i.e., content of $SiO_2$ was 70 wt. % of the mixture. With the mixture and iron powder were mixed together so as to obtain starting powder of which contents are listed on Table 5, where the content of the mixture was 0.3 wt. % of the starting powder. The starting powder was compressed to form green compacts in the same way of Ex. 1. The green compacts were heated up and kept at the temperature of 1,120 degrees C. for 1,800 seconds, which so called sintering process. Finishing the process, the pressured powder formed a test piece made of suitered material. The test piece was examined of flank wear of tools, and the result is also listed on Table 5.

TABLE 5

| | Content (wt. %) | | | | Flank wear |
|---|---|---|---|---|---|
| Test piece | Fe | Co | Gr | FeMo | (relative scaling) |
| Ex. 7 | * | 5.0 | 1.0 | 5.0 | 79 |

*stands for "The rest".
Gr: Graphite

As shown in Table 5 the flank wear of the tool was 79 in the relative scaling. The molar ratio of the composite materials in Ex. 7 was 1.8, while the same in Ex. 3 was 2.00. Even though the molar ratios are close to each other, the flank wear in Ex. 7 and the same in Ex. 3 differ from each other. It is supposed that the difference of frank wear comes from content difference of $SiO_2$.

Other Preferred Embodiments

FeMo were happened to be used as hard particles in the embodiments mentioned above, however, Fe—W, Fe—Cr, Tribaloy, etc. can be used in the same or the other kind of sintered materials. The diameter of the hard particles are beneficial in the range of 50 through 150 micrometers.

Also in above-mentioned embodiments, pure iron powder, Co powder, FeMo powder and natural graphite powder were blended at the ratios as listed on the Tables, which would form metal matrix of iron family. The ratios, however, are not restricted nor limited by above-listed ratios, but rather tuned depend on requirements and contents of sintered materials. The blend ratio. can be tuned in the range that Co powder of 2–15 wt. %, FeMo powder of 2–30 wt. %, natural graphite powder of 0.3–1.7 wt. %, composite oxides powder of 0.01–1.2 wt. %, and the rest are iron substantially.

Comments

Above-mentioned studies on embodiments and comparatives leads to following insight that the sintered material can be applied as material for valve seats of internal combustion engines, where the sintered material can be produced by the process of present invention. Greater strength at high temperature, improved wear resistance and also improved machinability are expected in the valve seats made of the sintered materials or the present invention.

What is claimed is:

1. A sintered material having good machinability, in which composite oxide is dispersed in metal matrix, wherein said composite oxide consists essentially of CaO—MgO—$SiO_2$, in which the molar ratio or CaO/MgO is more than or equal to 0.05 and less than or equal to 2.0, and in which the content of $SiO_2$ is more than or equal to 50 wt. % and less than or equal to 75 wt. %.

2. The sintered material having good machinability according to claim 1, wherein said composite oxide consists essentially of diopside phase of CaO—MgO—$SiO_2$.

3. The sintered material having good machinability according to claim 1, wherein said composite oxide consists essentially or diopside phase of CaO—MgO—$SiO_2$, and contains $(Ca,Mg)_2SiO_4$ which has forsterite structure in which a part of Mg has been substituted with Ca.

4. The sintered material having good machinability according to claim 1, wherein said composite oxide consists essentially or diopside phase of CaO—MgO—$SiO_2$, and $(Ca,Mg)SiO_3$ which has protoenstatite structure in which a part of Mg has been substituted with Ca.

5. The sintered material having good machinability according to claim 1, wherein said composite oxide consists essentially of diopside phase of CaO—MgO—$SiO_2$, $(Ca,Mg)_2SiO_4$ and $(Ca,Mg)SiO_3$.

6. The sintered material having good machinability according to claim 1, wherein mean diameter of said composite oxide is in the range of from 3 micrometers to 200 micrometers.

7. The sintered material having good machinability according to claim 1, wherein said metal matrix are formed with sintered phase processed from Fe-dominant powder.

8. The sintered material having good machinability according to claim 1, wherein said metal matrix are formed with sintered phase processed from the mixture of Fe-dominant powder and Co powder.

9. The sintered material having good machinability according to claim 1, wherein hard particles are dispersed in said metal matrix.

10. The sintered material having good machinability according to claim 9, wherein said hard particles are at least one selected from the group consisting essentially of FeMo particles, FeCr particles, FeW particles, and Tribaloy particles.

11. The sintered materials having good machinability according to claim 9, mean diameter of said hard particles is in the range of from 50 micrometers to 150 micrometers.

12. The sintered materials having good machinability according to claim 1, which are used to form at least one selected from the group consisting of a valve seat and a valve guide of an internal-combustion engine.

13. A sintered material having good machinability and high strength in which composite oxide is dispersed in metal matrix, wherein said composite oxide consists essentially of CaO—MgO—$SiO_2$, in which the molar ratio of CaO/MgO is more than or equal to 0.05 and less than or equal to 2.0, and in which the content of $SiO_2$ is more than or equal to 50 wt. % and less than or equal to 75 wt. %, and wherein said composite oxides are included in said sintered material by less than or equal to 1.5 wt. %, where said sintered material is referred as 100 wt. %.

14. The sintered material having good machinability according to claim 13, wherein the content of said composite oxide is in the range of from 0.01 wt. % to 1.5 wt %, where said sintering material is referred as 100 wt. %.

15. The sintered material having good machinability according to claim 13, wherein said composite oxide consists essentially of diopside phase.

16. The sintered material having good machinability according to claim 13, wherein said composite oxide consists essentially of diopside phase of CaO—MgO—$SiO_2$ and contains $(Ca,Mg)_2SiO_4$ which has forsterite structure in which a part of Mg has been substituted with Ca.

17. The sintered material having good machinability according to claim 13, wherein said composite oxide consists essentially of diopside phase of CaO—MgO—$SiO_2$ and contains (Ca,Mg)$SiO_3$ which has protoenstatite structure in which a part of Mg has been substituted with Ca.

18. The sintered material having good machinability according to claim 13, wherein said metal matrix are formed with sintered phase which was made from Fe-dominant powder.

19. The sintered material having good machinability according to claim 13, wherein said metal matrix are made of sintered phase which was formed from mixture of Fe-dominant powder and Co powder by sintering.

20. The sintered material having good machinability according to claim 13, wherein hard particles are dispersed in said metal matrix.

21. The sintered material having good machinability according to claim 20, wherein said particles are at least one selected from the group consisting of FeMo particles, FeCr particles, FeW particles, and Tribaloy particles.

22. The sintered material having good machinability according to claim 20, wherein mean diameter of said hard particles is in the range of from 50 micrometers to 150 micrometers.

23. The sintered material having good machinability according to claim 13, which are used to form at least one selected from the group consisting of a valve seat and a valve guide of an internal-combustion engine.

24. A process for producing a sintered material having good machinability, comprising the steps of:

a first step for mixing composite oxides powder and metal powder to obtain mixture powder, wherein said composite oxides powder consists essentially of a compound from which Ca isolates easily and magnesium silicic acid compound containing MgO and $SiO_2$, and wherein said metal powder is to form a metal matrix by sintering in the following third step;

a second step for pressing said mixture powder to form a pressed body (herein referred to as "green compact");

a third step for heating up said green compact to a temperature range for sintering and for keeping said green compact in said temperature range for a certain duration so that composite oxides of CaO—MgO—$SiO_2$ family are synthesized and said green compact forms sintered material;

wherein said sintered material consists essentially of said metal matrix and said composite oxides of CaO—MgO—$SiO_2$ family dispersed in said metal matrix, wherein the molar ratio of CaO/MgO in said composite oxides of CaO—MgO—$SiO_2$ family is more than or equal to 0.05 and less than or equal to 2.0, and the content of $SiO_2$ in said composite oxides of CaO—MgO—$SiO_2$ family is more than or equal to 50 wt. % and less than or equal to 75 wt. %.

25. The process for producing a sintered material having good machinability according to claim 24, wherein said metal powder consists essentially of Fe powder, and in said third step, said green compact is heated from room temperature to the sintering temperature range of from 1,000 degrees C. to 1,300 degrees C.

26. The process for producing a sintering material having good machinability according to claim 24, wherein said composite oxides consist essentially of diopside phase of CaO—MgO—$SiO_2$.

27. The process for producing a sintering material having good machinability according to claim 24, wherein natural compounds containing CaMg are used as said compound from which Ca isolates easily.

28. The process for producing a sintering material having good machinability according to claim 27, wherein said natural compounds containing CaMg contains at least one selected from the group consisting of $CaMg(CO_3)_2$, $CaCO_3$, $Ca(OH)_2$, and $CaSO_4$.

29. The process for producing a sintered material having good machinability according to claim 27, wherein said natural compounds containing CaMg are dolomite or natural compounds containing dolomite.

30. The process for producing a sintered material having good machinability according to claim 24, wherein said magnesium silicic acid compound has the constitution of $Mg_xSi_yO_{x+2y}$.

31. The process for producing a sintered material having good machinability according to claim 30, wherein natural compounds are used as said magnesium silicic acid compound, and they are one selected from the group consisting of enstatite and forsitelite.

* * * * *